US005709347A

United States Patent [19]

Hoffmann et al.

[11] Patent Number: 5,709,347

[45] Date of Patent: Jan. 20, 1998

[54] DEVICE FOR ELECTROMAGNETICALLY BRAKING AND CLUTCHING A SPOOL

[75] Inventors: Ernst Hoffmann, Langenhagen; Wolfram Klebl, Isernhagen; Harry Staschewski, Langenhagen, all of Germany

[73] Assignee: Alcatel Kabel AG & Co, Germany

[21] Appl. No.: 687,081

[22] Filed: Jul. 23, 1996

[30] Foreign Application Priority Data

Jul. 24, 1995 [DE] Germany ..... 195 26 913.6

[51] Int. Cl.[6] ..... B65H 75/30; B65H 59/02; D02G 3/36

[52] U.S. Cl. ..... 242/46.4; 242/35.5 T; 242/422.2; 242/597.6; 57/14; 192/69.42

[58] Field of Search ..... 242/46.2, 46.4, 242/35.5 T, 597.6, 388.8, 394, 422.2, 545; 57/14; 192/69.42

[56] References Cited

U.S. PATENT DOCUMENTS

| | | | |
|---|---|---|---|
| 2,746,691 | 5/1956 | Hoad | 242/46.2 |
| 3,396,919 | 8/1968 | Vayda | 242/597.6 X |
| 4,343,441 | 8/1982 | Graham | 242/545 |
| 4,387,556 | 6/1983 | Studtmann et al. | 242/46.2 X |
| 4,958,780 | 9/1990 | Bruenn et al. | 242/422.2 X |

FOREIGN PATENT DOCUMENTS

| | | | |
|---|---|---|---|
| 0337052 | 10/1989 | European Pat. Off. . | |
| 945 322 | 7/1956 | Germany | 242/46.2 |
| 1632910 | 3/1991 | U.S.S.R. | 242/46.4 |

*Primary Examiner*—Michael Mansen
*Attorney, Agent, or Firm*—Ware, Fressola, Van der Sluys & Adolphson LLP

[57] ABSTRACT

A device (24) is provided for the electromagnetic braking and clutching of at least one storage spool (7). Each storage spool is located on a hollow shaft (5) and can rotate around its longitudinal axis (25). Each storage spool permits strand-shaped materials to be drawn therefrom and strand-shaped materials to be wound thereon when the storage spool (7) is driveably connected to the hollow shaft (5). The electromagnetic braking and clutching device includes a star-shaped support unit (31) that is securely affixed to the hollow shaft (5) and has a number of radially extending holding devices (37) distributed around its periphery. The support unit (31) holds at least one electrically excitable magnet coil (45) radially by using of a holding device (37), at a distance from the hollow shaft (5). The device is particularly suited for braking and clutching storage spools (7) with large outside diameters, which are located on a hollow shaft (5).

12 Claims, 4 Drawing Sheets

DEVICE FOR ELECTROMAGNETICALLY BRAKING AND CLUTCHING A SPOOL

BACKGROUND OF THE INVENTION

1. Technical Description

The invention concerns a device for the electromagnetic braking and clutching of at least one storage spool, which can rotate around the lengthwise axis of a hollow shaft, from which strand-shaped materials can be drawn, and onto which strand-shaped materials can be wound when the storage spool is drivingly connected to the hollow shaft.

2. Description of the Prior Art

EP 0 337 052 A1 describes a device for braking and clutching spools which can rotate freely around the longitudinal axis of a hollow shaft, from which strand-shaped materials such as ribbons, wires, filaments and such can be drawn, and onto which corresponding strand-shaped materials can be wound when the spools are affixed to the driven hollow shaft. In this instance, the power of an electromagnetic field is used to produce the brake torque or the torque transmission. To that end, an annular electromagnet comprising an excitation coil and a magnet yoke is arranged around the hollow shaft and is securely affixed thereto.

In textile machines, in twisting or cabling machines etc., the known device enables the braking of spools from which strand-shaped materials such as ribbons, wires or filaments are drawn, so that the take-off material is under constant or at least nearly constant tension, to prevent the strand-shaped material from vibrating or tearing. The brake torque of the electromagnet can be regulated with the magnitude of the excitation current. To enable the rewinding of ribbons or wires onto the storage spools when they are empty, the magnet coil is fully excited so that the necessary torque can be transmitted from the driven hollow shaft to the storage spools, without slippage.

In practice, the hollow shaft is driven at a high rpm to enable rewinding the strand-shaped material onto the storage spools in as short a time as possible. For reasons of vibration and strength, it is advisable for the hollow shaft to have a large external diameter. In addition, the rewinding of longitudinally extending materials having a large external size requires a hollow shaft with a large internal diameter and a correspondingly large external diameter. Since the annular electromagnet surrounds the hollow shaft in the known device, an electromagnet with a correspondingly large diameter must be used. However, this can lead to difficulties, since such large electromagnets are hard to find and in addition are costly.

SUMMARY OF THE INVENTION

Starting from this state of the art, it is an object of the invention to provide an adjustable device for the electromagnetic braking and clutching of at least one storage spool which is located on a hollow shaft and can rotate around its longitudinal axis, and which can be manufactured in a simple and cost-effective manner even for hollow shafts with large-size external diameters.

It is also an object to provide an approximately star-shaped support unit placed on the hollow shaft. The star-shaped support unit has a number of radially outward extending holding devices distributed around its periphery and is securely affixed to the hollow shaft. Each holding device supports at least one electrically excitable magnet coil in the radial direction on the support unit spaced from the hollow shaft.

The advantages that can be attained with the invention include particularly that the device according to the invention can be manufactured in a simple and cost-effective manner without resorting to extra-large annular electromagnets, even when a hollow shaft with a large-size external diameter is used. If several electrically excitable magnet coils are held on the approximately star-shaped support unit, it is possible to excite only one of the magnet coils to simply adjust the brake torque during braking, but to excite all the magnet coils when clutching the storage spool to the driven hollow shaft. Furthermore, with the device according to the invention, the storage spools can be dismounted in simple fashion.

It is advantageous for the synchronous operation of the driven hollow shaft if the magnet coils are uniformly distributed around the periphery of the storage spool.

It is an advantage if a braking surface is provided on the side of the storage spool that faces the at least one magnet coil, and each magnet coil has a friction surface on the side facing the storage spool which is being slowed down, so that an effective braking or clutching of the at least one rotating storage spool is made possible, in addition to the simple construction of the device according to the invention.

To enable a rapid, simple and cost-effective replacement when the allowable wear on the friction surface has been exceeded, it is advantageous if a friction cap is arranged on each magnet coil and at least partially surrounds it. Ideally, the friction cap has a friction surface on the side facing the storage spool and is replaceable.

It is an advantage for a simple and exact regulation of the desired brake torque if each magnet coil can be individually excited, and if the excitation current is continuously variable.

To correct production tolerances, oblique positions and the appearance of wear, it is advantageous if the at least one magnet coil is able to tilt with respect to the support unit.

To prevent the formation of chips on the braking surface of the storage spool and on the friction surface of the at least one magnet coil, it is advantageous if the outside of the magnet coil is surrounded by an annular jacket made of a low-friction sliding material, and if a central aperture on the annular magnet coil is closed at the end that faces the braking surface of the storage spool by a disk made of a low-friction sliding material.

Two embodiments of the invention are illustrated in simplified form in the drawings and are explained in greater detail by the following description.

DETAILED DESCRIPTION OF THE INVENTION

Figure 1:
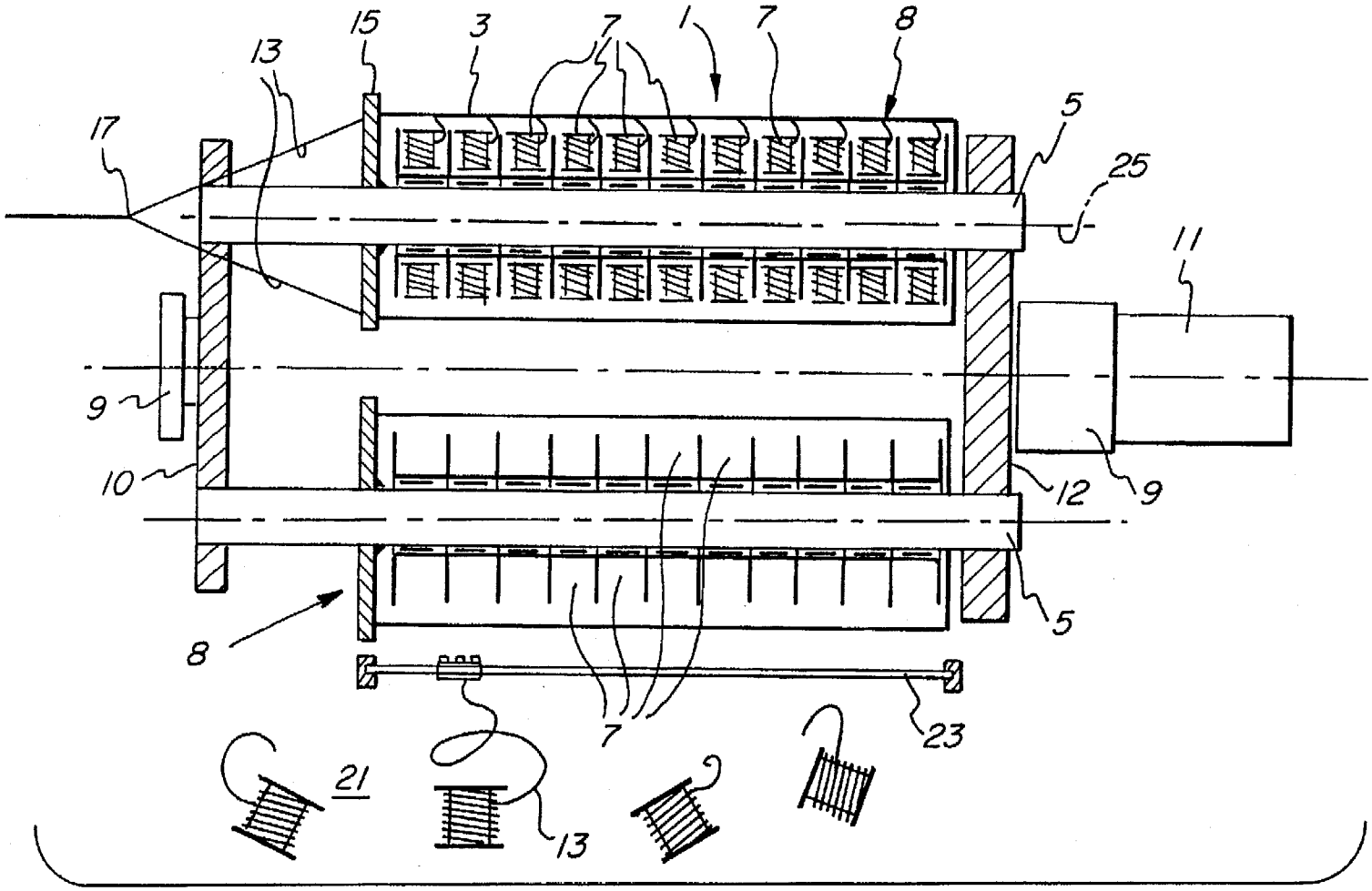
FIG. 1 (PRIOR ART)
FIG. 1 schematically illustrates a twisting or cabling device in which the twisting head and storage spools are combined into one unit and are provided in double configuration.

Two tubular cabling bodies 3 are provided in the twisting or cabling device 1 illustrated as an example in FIG. 1 for twisting or cabling ribbons, wires, filaments and the like. Each of the cabling bodies 3 surrounds a driveable hollow shaft 5 on which a number of storage spools 7 are rotatably mounted. However, each hollow shaft 5 can also be provided with only a single storage spool 7. The two cabling units 8 each comprising a hollow shaft 5, the storage spools 7 arranged thereon and the surrounding cabling body 3, are joined in their position to each other by means of two cross bars 10 and 12 and are held together by a post 9. When the upper cabling body 3 (as viewed in FIG. 1) rotates around its longitudinal axis 25, the strand-shaped materials 13, e.g. single wires, are drawn from the storage spools 7 and after passing over a guide disk 15 affixed to the hollow shaft 5, are routed to a twisting point 17. Such rotation of the upper cabling body 3 is provided by a driving unit 11. If the strand-shaped materials 13 are not twisted around each other but are wound onto a cable core for example, the cable core is routed to the twisting point 17 through the hollow shaft 5.

The two identically constructed cabling units 8 are arranged next to each other in one plane, thus in parallel. They can swing in opposite directions from each other by means of a suitable changing mechanism (not shown). When the storage spools 7 of one of the cabling units 8 are empty, this empty cabling unit is swung from its operating position and the other full cabling unit 8 is simultaneously brought into the operating position. To refill the empty spools on the removed cabling unit 8, a loading station 21 illustrated as an example is used, in which a suitable magazine contains strand-shaped materials 13, e.g. wires of different sizes, with which the empty storage spools 7 are filled according to a respective program by a schematically indicated loading device 23. The loading process can also take place automatically like the respective swinging of the cabling units 8 into or out of the operating position.

Figure 2:
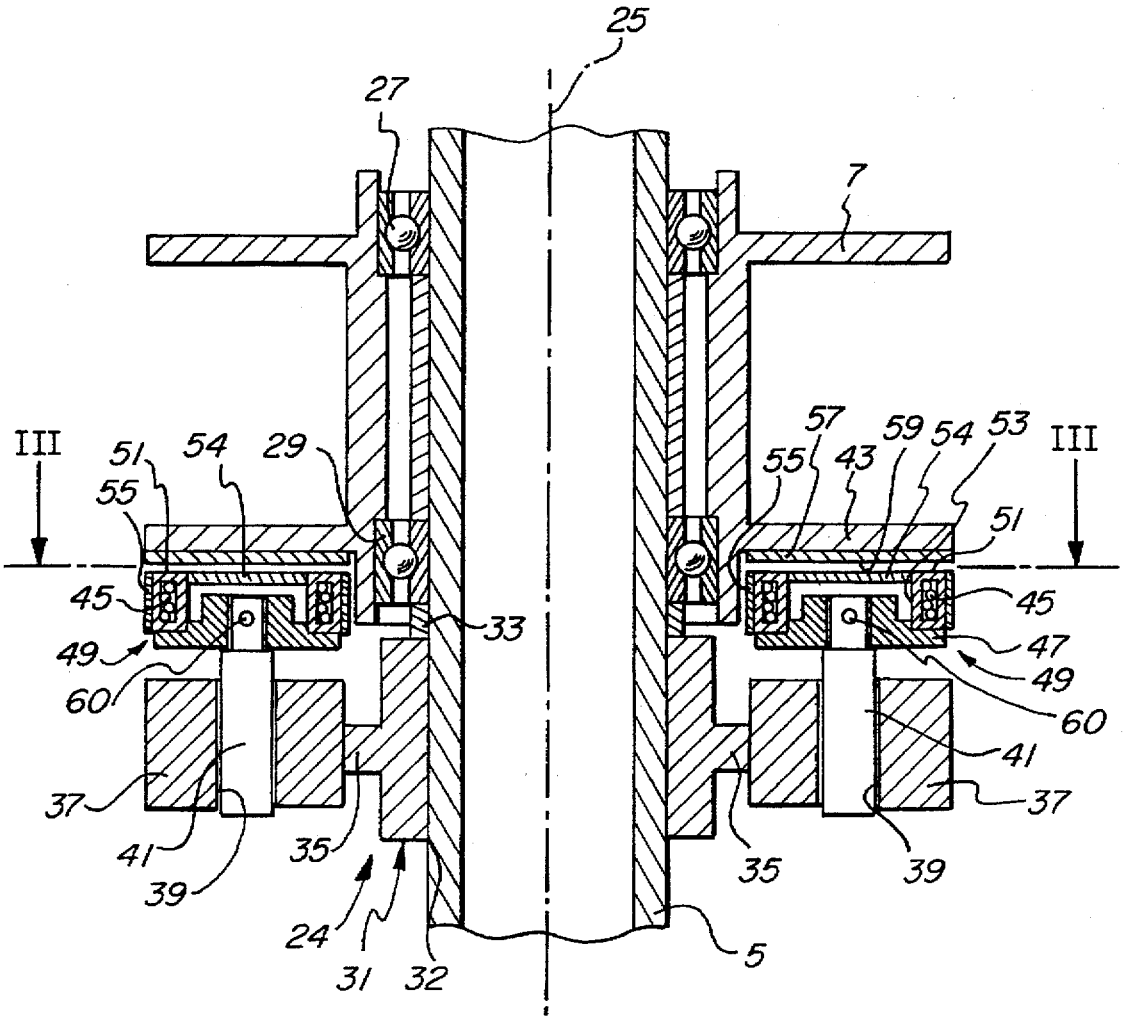
FIG. 2 is a cross-sectional view of a first embodiment of a device according to the invention for the electromagnetic braking and clutching of a rotating storage spool.
Figure 3:
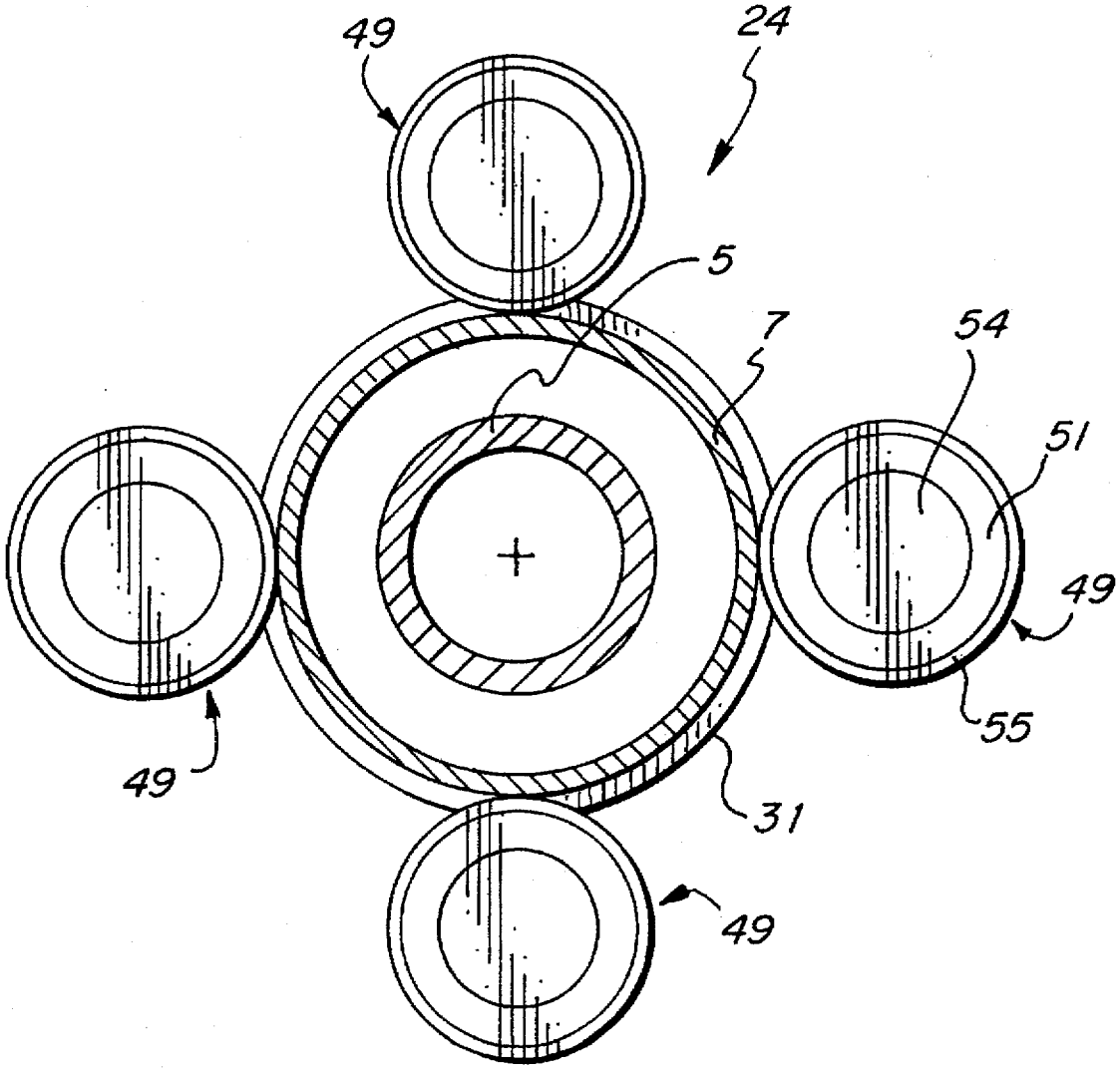
FIG. 3 is a cross-sectional view along line III—III in FIG. 2.
Figure 4:
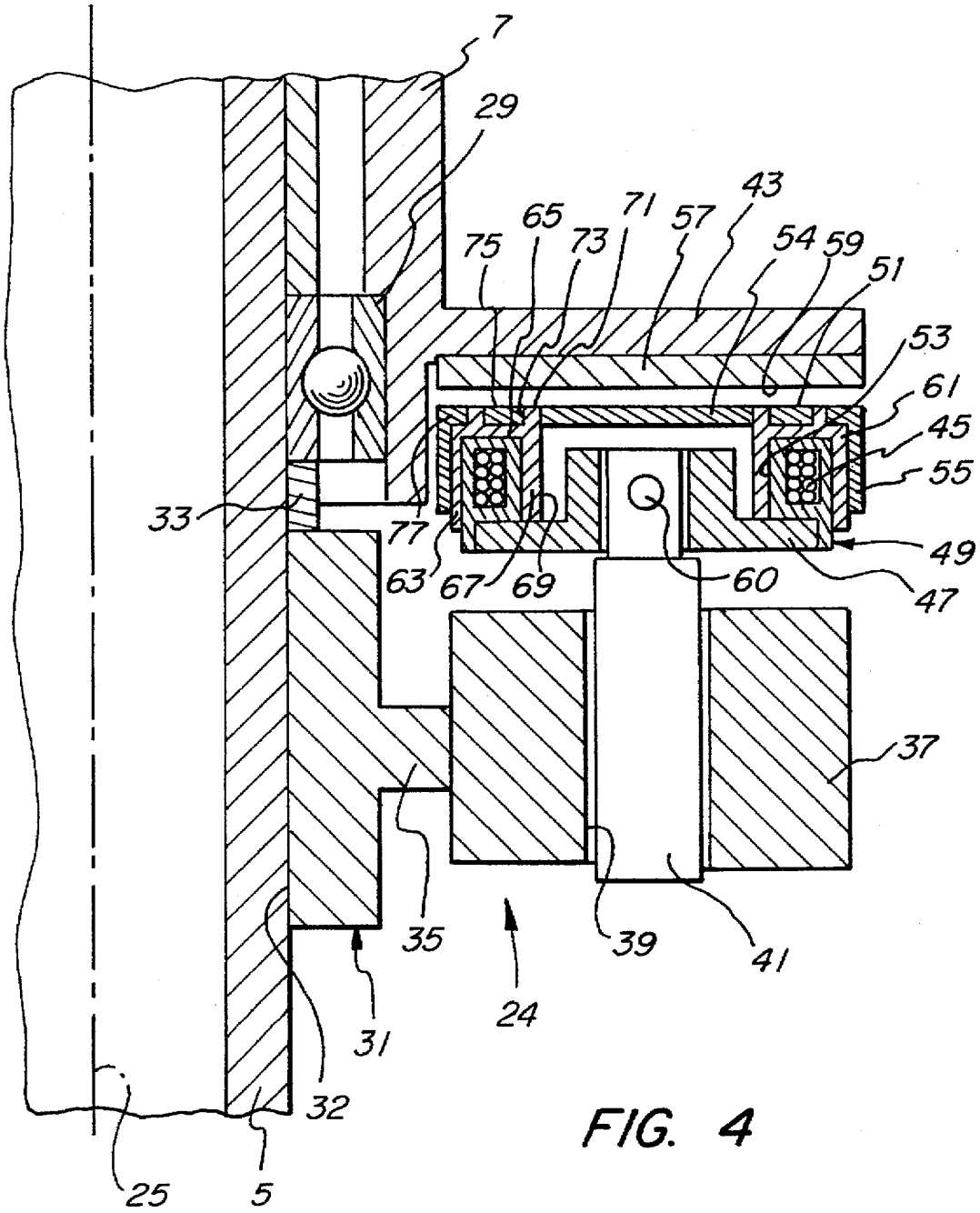
FIG. 4 is a cross-sectional view of a second embodiment of a device according to the invention.

Referring now to FIGS. 2 to 4, the two cabling units 8 are equipped with facilities of the invention for the electromagnetic braking and clutching of storage spools 7 which are arranged on the hollow shafts 5 and can rotate around the longitudinal axes 25 to receive strand-shaped materials 13. The devices 24 of the invention are used to brake the storage spool 7 while the strand-shaped materials are taken off, to provide a constant or at least nearly constant tension to the take-off materials, and to prevent the strand-shaped materials from vibrating or tearing. The device 24 is also used to fill the storage spool 7 with strand-shaped materials by providing a power connection between the hollow shaft 5, which is driven during the loading process by the driving unit 11, and at least one storage spool 7.

The device 24, illustrated in FIGS. 2 and 3 in cross-sectional views of a cabling unit 8, comprises a storage spool 7 arranged to rotate on the hollow shaft 5 by means of two ball bearings 27 and 29. An approximately star-shaped support unit 31 is located on one side of the hollow shaft 5, next to the storage spool 7. The central bore 32 of the support unit 31 is pushed onto the hollow shaft 5 and is secured thereto by press fitting or by means of a key and groove connection. The distance in the axial direction between the support unit 31 and the storage spool 7 is established by a spacer ring 33 placed between the support unit 31 and the ball bearing 29. The support unit 31 has four radially outward pointing webs 35 which are uniformly distributed around the periphery, where each of their outer ends is provided with an annular receiving part 37. Each of these receiving parts 37 has a passage hole 39 that extends parallel to the longitudinal axis 25 of storage spool 7 and in which a pin 41 can move longitudinally. The pins 41 are keyed to their respective receiving parts 37 to prevent rotation but allow longitudinal movement.

Each of the pins 41 has an electromagnet 49, composed of an annular magnet coil 45 and a magnet yoke 47, which is attached to the end that faces one of the flanges 43 of the storage spool 7 being braked or clutched. Each of the magnet coils 45 has an annular friction surface 51 which faces the flange 43 of the storage spool 7. In the illustrated embodiment in FIG. 2, a central aperture 53 in each annular magnet coil 45 is closed on the side that faces the spool flange 43 by a disk 54 made of a low-friction sliding material, such as brass. The periphery of the magnet coil 45 is surrounded by an annular jacket 55 made of a low-friction sliding material such as brass.

On the side facing the friction surfaces 51 of the electromagnets 49, the flange 43 of storage spool 7 has an annular brake disk 57 which forms a braking surface 59 in cooperation with the friction surfaces 51 of the electromagnets 49.

Each of the magnet coils 45 of electromagnets 49 can be electrically excited with the excitation current being variable. When the take off of the material 13 from the storage spool 7 is desired, the magnet coils 45 are only excited up to a magnitude dependent on the desired braking moment. The friction surfaces 51 of the electromagnets 49 are pressed against the braking surface 59 of the storage spool 7 but only with a low force due to the low magnitude of the excitation current. There is then a slippage, that is a relative turning movement between the friction surfaces 51 and the braking surface 59 which results in respective friction losses. The braking torque and thus the relative speed between the hollow shaft 5 which is standing still and the storage spool 7 is adjustable in relation to the excitation current. In this way, when a strand-like material 13 is drawn from the storage spool 7, the latter can be braked at a defined braking torque in order to provide tension to the strand-shaped material 13 to prevent it from vibrating or tearing. By contrast, when a strand-shaped material 13 is wound onto the storage spool 7, all magnet coils 45 are electrically fully excited, so that the friction surfaces 51 of the electromagnets 49 are applied without slippage against the braking surface 59 of the respective storage spool 7 and thus form a power connection. The storage spool 7 then rotates together with the hollow shaft 5 as they are driven by driving unit 11 around the longitudinal axis 25 whereby the strand shaped material 13 is wound onto the storage spool 7.

It is also possible to electrically excite only one of the magnet coils 45 for braking of the storage spool 7.

The magnet coils 45 can slightly tilt with respect to the support units 31. The magnet coil 45 is connected to the pin 41 by means of a pivot pin 60 in such a manner that the magnet coil 45 is tiltable around the pivot pin 60. The pivot pin 60 is loosely inserted through a borehole of the pin 41 and firmly attached at both its ends to the magnet yoke 47.

The possibility of tilting the magnet coil 47 is very important as the flanges 43 of the storage spool 7 can be deformed outwardly when filled. In such a case, the braking surface 59 of the storage spool 7 and the friction surface 51 of the magnet coil 45 would not be parallel to one another. The tilting enables the friction surface 51 of the magnet coil 45 to adjust to an inclined position of the brake surface 59 of the storage spool 7.

To enable the use of a support unit to brake a second storage spool 7 which rotates on the hollow shaft 5, it is possible for the star-shaped support unit 31 to comprise further webs 35 and receiving parts 37 for guiding pins 41, which are used to hold electromagnets that point in opposite directions. Of course, with an unchanged number of receiving parts 37 only two electromagnets 49 each can be provided for braking and clutching a storage spool 7.

The second embodiment of the invention, which is illustrated in cross sectional fashion in FIG. 4, essentially differs only in the structure of electromagnets 49 and their friction surfaces 51 from the first embodiment illustrated in FIGS. 2 and 3. In the embodiment of FIG. 4, elements similar to those found in the first embodiment are designated with similar reference numerals. Thus, an annular friction cap 61 is provided, which encloses the magnet coil 45 in an outer cylindrical section 63. An annular radial section 65 of the friction cap 61 extends radially inward from the end of the outer cylindrical section 63 that faces away from the magnet yoke 47. An internal cylindrical section 67 of friction cap 61 protrudes into the central aperture 53 of the annular magnet coil 45, and starting from the radial section 65 it extends for in the axial direction to the magnet yoke 47, where it lies against the inner wall of the magnet coil 45. In this way, the magnet coil 45 is surrounded on three sides by the friction cap 61.

At the end that faces the braking surface 59 of the storage spool 7, a central aperture 69 through the friction cap 61 is closed by a disk 54 made of a low-friction sliding material, such as brass. At this end, an annular groove 73 is formed on the front 71 of the friction cap 61, wherein a friction ring 75 is located, which is made of a suitable material and forms the friction surface 51. The annular friction cap 61 is replaceable so that, if a previously established wear limit of the friction ring 75 forming the friction surface 51 has been exceeded, it can be easily quickly and cost-effectively replaced by changing the friction cap. The periphery of the friction cap 61 is surrounded by an annular jacket 55 made of a low-friction sliding material, such as brass, on which an annular step 77 extends inward in the radial direction on the front 71 of the friction cap 61.

The preferred embodiments described above admirably achieve the objects of the invention. However, it will be appreciated that departures can be made by those skilled in the art without departing from the spirit and scope of the invention which is limited only by the following claims.

What is claimed is:

1. A device for electromagnetically braking and clutching at least one storage spool rotatably mounted on a hollow shaft for rotation around a longitudinal axis of the hollow shaft, from which strand-shaped material can be drawn and onto which strand-shaped material can be wound when the storage spool is driveably connected to the hollow shaft, the device comprising:

(a) a generally star-shaped support unit located on the hollow shaft, the star-shaped support unit having a plurality of holding devices, each of the holding devices are on a peripheral portion of the star-shaped support, the holding devices extending outwardly in a radial direction from and being securely affixed to the hollow shaft; and (b) at least one electrically excitable magnet coil held by at least one of said holding devices of the support unit and spaced radially from the hollow shaft.

2. A device as claimed in claim 1, wherein the at least one electrically excitable magnet coil comprises at least four magnet coils.

3. A device as claimed in claim 2, wherein the magnet coils are uniformly distributed around a periphery of the at least one storage spool and are held by the holding devices of the support unit.

4. A device as claimed in claim 1, wherein a braking surface is provided on a side of the at least one storage spool which faces the at least one magnet coil.

5. A device as claimed in claim 4, wherein the at least one magnet coil has a friction surface which faces the storage spool to be braked.

6. A device as claimed in claim 1, wherein the at least one magnet coil is at least partially surrounded by a replaceable friction cap, the friction cap has a friction surface that faces the storage spool to be braked.

7. A device as claimed in claim 1, wherein the at least one magnet coil can be electrically excited individually.

8. A device as claimed in claim 1, wherein the at least one magnet coil has an excitation current which is variable.

9. A device as claimed in claim 1, wherein the at least one magnet coil can tilt with respect to the support unit.

10. A device as claimed in claim 1, wherein a peripheral portion of the at least one magnet coil is surrounded by an annular jacket made of a low-friction sliding material.

11. A device as claimed in claim 1, wherein the at least one magnet coil is annular and provides a central aperture which faces a braking surface of the at least one storage spool, a disk made of a low-friction sliding material is located in the central aperture.

12. A device as claimed in claim 1, wherein the at least one electrically excitable magnetic coil comprises a plurality of magnetic coils are uniformly distributed around a periphery of the at least one storage spool and are held by the holding devices of the support unit.

* * * * *